US011349216B2

(12) United States Patent
Lv et al.

(10) Patent No.: US 11,349,216 B2
(45) Date of Patent: May 31, 2022

(54) SECTOR DUAL-RESONANT DIPOLE ANTENNA

(71) Applicant: NANJING UNIVERSITY OF POSTS AND TELECOMMUNICATIONS, Nanjing (CN)

(72) Inventors: Wenjun Lv, Nanjing (CN); Zhibin Zhao, Nanjing (CN); Zhuang Li, Nanjing (CN); Han Wu, Nanjing (CN); Sijie Li, Nanjing (CN); Jianyuan Wang, Nanjing (CN); Zhifang Wu, Nanjing (CN); Xiaohui Li, Nanjing (CN); Hongbo Zhu, Nanjing (CN); Xiaofei Li, Nanjing (CN)

(73) Assignee: NANJING UNIVERSITY OF POSTS AND TELECOMMUNICATIONS, Nanjing (CN)

( * ) Notice: Subject to any disclaimer, the term of this patent is extended or adjusted under 35 U.S.C. 154(b) by 83 days.

(21) Appl. No.: 17/053,257

(22) PCT Filed: Jun. 16, 2020

(86) PCT No.: PCT/CN2020/096337
§ 371 (c)(1),
(2) Date: Nov. 5, 2020

(87) PCT Pub. No.: WO2021/031670
PCT Pub. Date: Feb. 25, 2021

(65) Prior Publication Data

US 2021/0376474 A1 Dec. 2, 2021

(30) Foreign Application Priority Data

Aug. 21, 2019 (CN) ..... 201910773228.7

(51) Int. Cl.
*H01Q 9/28* (2006.01)
*H01Q 5/10* (2015.01)
(Continued)

(52) U.S. Cl.
CPC ..... *H01Q 9/285* (2013.01); *H01Q 1/38* (2013.01); *H01Q 1/50* (2013.01); *H01Q 5/10* (2015.01); *H01Q 5/20* (2015.01); *H01Q 5/307* (2015.01)

(58) Field of Classification Search
CPC ..... H01Q 9/285; H01Q 1/38; H01Q 1/50; H01Q 5/10; H01Q 5/20; H01Q 5/307;
(Continued)

(56) References Cited

U.S. PATENT DOCUMENTS

2021/0367334 A1* 11/2021 Lv ..... H01Q 9/0442
2021/0367349 A1* 11/2021 Lv ..... H01Q 15/22

* cited by examiner

*Primary Examiner* — David E Lotter
(74) *Attorney, Agent, or Firm* — CBM Patent Consulting, LLC

(57) ABSTRACT

The present invention discloses a sector dual-resonant dipole antenna. Radiation elements of the antenna are two identical sector patches. Two identical rectangular notches can be symmetrically arranged or two identical tuning stubs can be symmetrically loaded on the sector patches at positions deviating from the central axis of the two sector patches. Exciting points are symmetrically arranged on sides of the sector patches close to a central axis. The present invention realizes a wide beamwidth radiation characteristic through a two-dimensional sectorial resonator, and then the notches are arranged or the tuning stubs are loaded at appropriate positions of two arms of the sectorial resonator, and thereby a dual-resonant characteristic can be realized within a working band.

7 Claims, 3 Drawing Sheets

(51) Int. Cl.

| | |
|---|---|
| ***H01Q 5/20*** | (2015.01) |
| ***H01Q 5/307*** | (2015.01) |
| ***H01Q 1/38*** | (2006.01) |
| ***H01Q 1/50*** | (2006.01) |

(58) Field of Classification Search
CPC ..... H01Q 5/15; H01Q 5/35; H01Q 9/065; H01Q 9/16
See application file for complete search history.

SECTOR DUAL-RESONANT DIPOLE ANTENNA

TECHNICAL FIELD

The present invention belongs to the technical fields of the Internet of Things and microwave, and particularly relates to a sector dual-resonant dipole antenna.

BACKGROUND

With the development of broadband wireless communication, the dual-resonant dipole antenna technology has been more and more widely applied. At present, most antennas used in mobile communication systems are single-mode resonant, and their bandwidth is very narrow, so there is an urgent need for a multi-mode resonant antenna with a larger bandwidth.

SUMMARY

Objective for the aforementioned problems, the present invention proposes a sector dual-resonant dipole antenna, which can show a dual-resonant characteristic within a working band, has a relative bandwidth of more than 60%, and is small in size, simple in structure and convenient to manufacture and implement.

Technical Solution in order to realize the objective of the present invention, the technical solution adopted by the present invention is as follows: a sector dual-resonant dipole antenna is disclosed, in which the radiation elements of the antenna are two identical sector patches; two identical rectangular notches can be symmetrically arranged or two identical tuning stubs can be symmetrically loaded on the sector patches at positions deviating from a central axis of the two sector patches; and exciting points are symmetrically arranged on the sides of the sector patches close to the central axis.

Further, the length ranges of the rectangular notches or the tuning stubs are from 0 to one third of a wavelength, and the width ranges are from 0 to one eighth of a wavelength; and the positions and the number thereof are determined by current distribution nulls in a first or second high-order resonant mode, and the rectangular notches or the tuning stubs can be symmetrically arranged relative to the central axis.

Further, the shapes of the loaded tuning stubs or rectangular notches are not limited.

Further, the arc length of each sector patch ranges from a quarter of a wavelength to a wavelength, the central angle of each sector patch is between 10° and 180°, and the radius range of each sector patch is from one tenth of a wavelength to a half of a wavelength.

Further, the two sector patches are not directly connected.

Further, the antenna is fed at the exciting points of the sector patches.

Further, the positions of the exciting points are 0.1 to 1 time the sector radius away from a circle center.

Advantages

The sector dual-resonant dipole antenna of the present invention has the structure of two identical sector patches, can achieve dual-resonant characteristics and a wider impedance bandwidth, and is characterized by a simple manufacturing process and low cost.

DETAILED DESCRIPTION

The technical solution of the present invention will be further described below with reference to the drawings and embodiments.

Figure 1:
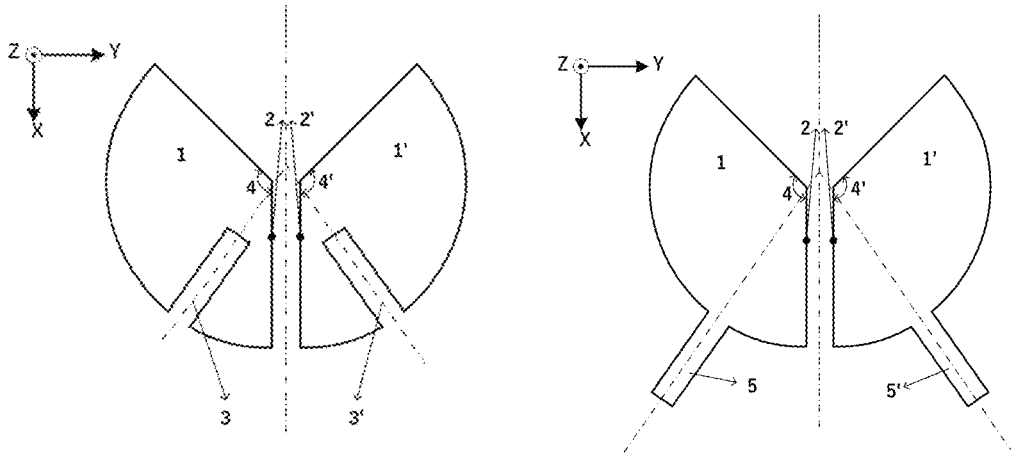
FIG. 1 is a top view of the antenna structure.

As shown in FIG. 1, the radiating element of the antenna of the present invention is a sector dipole, wherein the sector dipole structure consists of two identical sector patches (1) and two identical rectangular notches (3) or two identical tuning stubs (5) on the sector patches. And a two-dimensional current distribution of the sector dipole is utilized to realize a wide beamwidth characteristic. The lengths and widths of the rectangular notches or the tuning stubs may be 0. The shapes of the loaded tuning stubs or rectangular notches are not limited, and may be rectangular, L-shaped or other.

The technical solution of the present invention will be further illustrated below by a specific example, wherein the radius and central angle of the sector patch can be changed. the arc length of each sector patch ranges from a quarter of a wavelength to a wavelength, the central angle of each sector (4) is between 10° and 180°, and the radius range of each sector patch is from one tenth of a wavelength to a half of a wavelength. The resonant modes of the antenna are controlled by the arc lengths and central angles of the sector dipole, and two resonant modes are employed for radiation.

The positions of the rectangular notches and the stubs on the sector patches, i.e., angles relative to the positive direction of the x axis, can be changed. The length ranges of the rectangular notches or the tuning stubs are from 0 to one third of a wavelength, and the width ranges are from 0 to one eighth of a wavelength; and the positions and the number thereof are determined by current distribution nulls in a first or second high-order resonant mode, and the rectangular notches or the tuning stubs can be symmetrically arranged relative to the central axis.

The positions of exciting points on two arms of the sectorial resonator can be changed, that is, moved in the direction of the x axis. The exciting points (2) of the two arms of the sectorial resonator are located on sides of the sector patches close to the central axis, and the positions of the exciting points (2) are 0.1 to 1 time the sector radius away from the circle center. The two arms are not directly connected, and the antenna is fed at the exciting points of the two arms of the sectorial resonator.

Each characteristic of the antenna is calculated by simulation with HFSS software.

Figure 2:
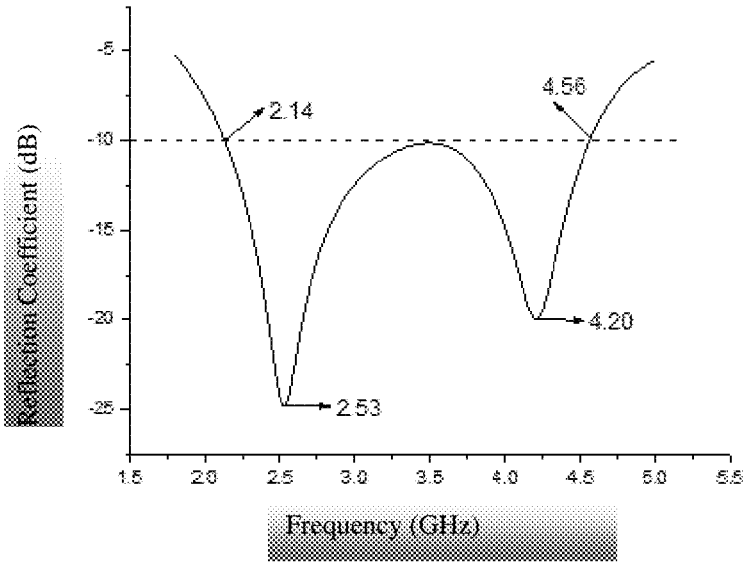
FIG. 2 is a schematic diagram of antenna reflection coefficient drawn by HFSS (High-Frequency Structure Simulator)

FIG. 2 is a schematic diagram of antenna reflection coefficient. As shown in FIG. 2, the impedance bandwidth of the antenna is from 2.14 GHz to 4.56 GHz, the center frequency is 3.25 GHz, the relative bandwidth is about 74%, and a dual-resonant characteristic is realized at 2.53 GHz and 4.20 GHz.

Figure 3:
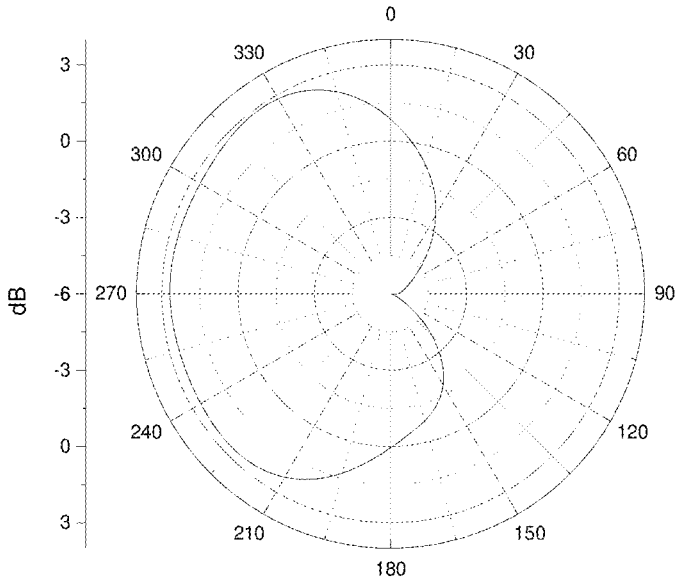
FIG. 3 is an antenna pattern in a ZX plane drawn by HFSS.
Figure 4:
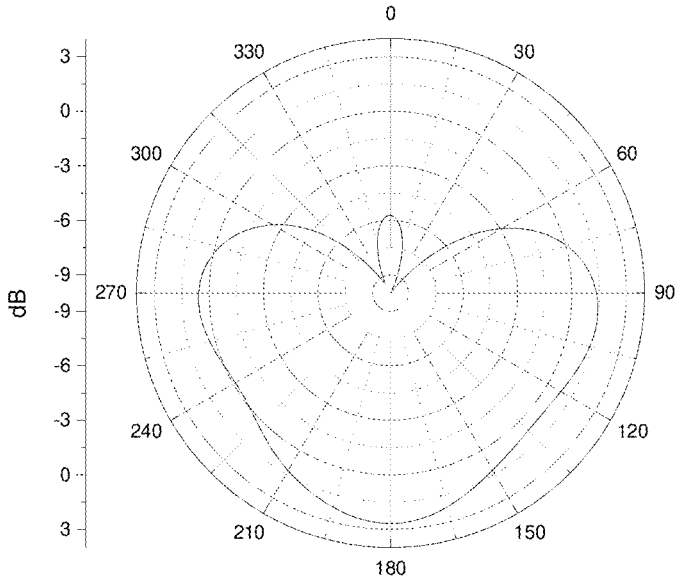
FIG. 4 is an antenna pattern in an XY plane drawn by HFSS.

The radiation patterns of the antenna are as shown in FIG. 3 and FIG. 4, wherein FIG. 3 is the co-polarization pattern of the ZX plane of the antenna, which shows that the half-power beamwidth of the antenna can reach more than 150°; and FIG. 4 is the co-polarization pattern of the XY plane of the antenna, which shows that the half-power beamwidth of the antenna can reach more than 150°.

Figure 5:
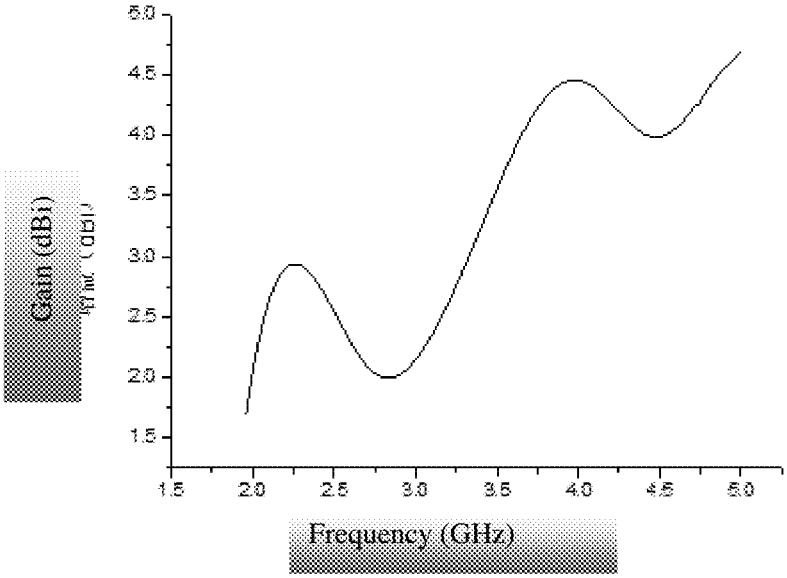
FIG. 5 is a schematic diagram of antenna gain frequency response drawn by HFSS.

FIG. 5 shows the frequency response characteristic curve of the antenna gain within the working frequency band. It can be seen that the average gain of the antenna in the maximum radiation direction can reach 3.3 dBi, and the gain at the center frequency is about 3 dBi.

The design of the sector dual-resonant dipole antenna of the present invention can realize the dual-resonant characteristic, and is characterized by small size, wide bandwidth, wide beamwidth, simple structure and convenient manufacturing and implementation.

What is claimed is:

1. A sector dual-resonant dipole antenna, wherein radiation elements of the antenna are two identical sector patches (1); two identical rectangular notches (3) are symmetrically arranged or two identical tuning stubs (5) are symmetrically loaded on the sector patches at positions deviating from the central axis of the two sector patches; and exciting points (2) are symmetrically arranged on sides of the sector patches close to a central axis.

2. The sector dual-resonant dipole antenna according to claim 1, wherein the length ranges of the rectangular notches or the tuning stubs are from 0 to one third of a wavelength, and the width ranges are from 0 to one eighth of a wavelength; and the positions and the number thereof are determined by current distribution nulls in a first or second high-order resonant mode, and the rectangular notches or the tuning stubs are symmetrically arranged relative to the central axis.

3. The sector dual-resonant dipole antenna according to claim 1, wherein the shapes of the loaded tuning stubs or rectangular notches are not limited.

4. The sector dual-resonant dipole antenna according to claim 1, wherein the arc length of each sector patch ranges from a quarter of a wavelength to a wavelength, the central angle of each sector is between 10° and 180°, and the radius range of each sector patch is from one tenth of a wavelength to a half of a wavelength.

5. The sector dual-resonant dipole antenna according to claim 1, wherein the two sector patches are not directly connected.

6. The sector dual-resonant dipole antenna according to claim 1, wherein the antenna is fed at the exciting points of the sector patches.

7. The sector dual-resonant dipole antenna according to claim 1, wherein the positions of the exciting points are 0.1 to 1 times the sector radius away from the circle center.

* * * * *